United States Patent [19]

Lin

[11] 4,055,040

[45] Oct. 25, 1977

[54] ALTERNATELY TWISTED YARN ASSEMBLY AND METHOD FOR MAKING

[75] Inventor: Perry Han-Cheng Lin, Seaford, Del.

[73] Assignee: E. I. Du Pont de Nemours and Company, Wilmington, Del.

[21] Appl. No.: 676,423

[22] Filed: Apr. 13, 1976

[51] Int. Cl.[2] ..... D02G 3/28; D02G 3/38

[52] U.S. Cl. ..... 57/140 BY; 57/34 AT; 57/144; 57/157 AS; 57/160

[58] Field of Search ..... 57/34 AT, 144, 140 BY, 57/140 J, 160, 157 AS

[56] References Cited

U.S. PATENT DOCUMENTS

| | | | |
|---|---|---|---|
| 3,225,533 | 12/1965 | Henshaw | 57/34 AT |
| 3,443,370 | 5/1969 | Walls | 57/34 AT |
| 3,468,120 | 9/1969 | Hildebrand | 57/34 AT |
| 3,537,251 | 11/1970 | Kimura et al. | 57/34 AT X |
| 3,639,807 | 2/1972 | McCune | 57/157 AS X |

FOREIGN PATENT DOCUMENTS

| | | | |
|---|---|---|---|
| 1,047,503 | 11/1966 | United Kingdom | 57/34 AT |

*Primary Examiner*—Jerry W. Myracle
*Assistant Examiner*—Charles Gorenstein

[57] ABSTRACT

Alternate-twist plied yarns, wherein a secondary strand for providing a special effect is plied with at least two alternately, false-twisted primary strands, are made by converging the secondary strand with the primary strands downstream of the point at which the primary strands are converged. The nodes at the twist reversal points for the secondary strand are displaced with respect to nodes of the primary strands. Improved effectiveness from the secondary strand in the plied yarn, such as better antistatic performance, can be realized. Where a node of a secondary strand overlaps a node of the primary strands, whether or not the node centers are displaced, a preferred configuration is one wherein the secondary strand forms a node by wrapping around only one of the primary strands in a portion of the primary node.

13 Claims, 4 Drawing Figures

ALTERNATELY TWISTED YARN ASSEMBLY AND METHOD FOR MAKING

BACKGROUND OF THE INVENTION

1. Field of the Invention

This invention concerns novel, plied yarns containing alternating S and Z regions of false-twist and a novel method for the manufacture of such yarns. More particularly, the plied yarns of this invention contain, for the purpose of introducing a special effect, one ply having a distinctively different property from at least two other plies.

2. Description of the Prior Art

In textile yarns, it is common practice to employ one or more plies of an "effect" yarn to modify the properties of the resulting plied yarn. The results of the modification depend upon the particular manner in which the yarns are combined with one another. For example, a low denier, antistatic yarn when ply-twisted with a heavy denier, multifilament, bulked, carpet yarn is known in the art to provide better antistatic protection in the plied yarn when ply-twisted under conditions result in the antistatic yarn being located more frequently at or near the surface of the plied yarn.

Plied, twist-stable, yarn structures comprising a plurality of strands which are plied about one another by alternating S and Z regions of twist and the preparation of such structures are described in U.S. Pat. No. 3,225,533 and in British Pat. Spec. No. 1,047,503. U.S. Pat. No. 3,468,120 describes a method for the preparation of such yarns having improved quality; however, when a modifying yarn such as an antistatic yarn is employed as one of the strands in this method, the most desirable results are not necessarily obtained. Such factors as the manner in which the different strands ply with one another and the sensitivity of the desired modification to the final, plied yarn configuration affect the results.

SUMMARY OF THE INVENTION

This invention concerns a novel method for incorporating a modifying strand into an alternate-twist plied yarn and novel products produced by the method. The method of the invention independently controls the plying action of the modifying strand with respect to the other strands. Consequently, for some products, more effective use can be made of the modifying strand in the plied yarn than is provided by prior means.

According to this invention, there is provided in the method for making an alternate-twist, plied yarn including applying false-twist as alternate S and Z regions of twist repeatedly throughout the lengths of at least two, primary, separated, multifilament, textile strands, said regions of twist being separated by nodes of zero twist, converging the false-twisted strands without snubbing immediately downstream of the point at which the twist is applied, and snubbing the converged strands at a point downstream of the twisting point a distance less than the distance between nodes and greater than one-half the distance between nodes, and permitting the twisted regions of the converged strands to partially untwist and to ply-twist with one another while constraining the untwisting of the strands in the plying zone sufficiently to slow down but not prevent untwisting and plying of the strands, the improved method for incorporating a secondary strand into the plied yarn comprising converging a secondary strand with the primary strands at a point in the constrained, plying zone downstream of the convergence point of the primary strands, and permitting the secondary strand to ply with and alternately twist around the primary strands.

Also there is provided an improved unitary, twist-stable yarn including a plurality of alternately-twisted multifilament strands which are plied about one another in alternating S and Z regions of twist repeatedly throughout the length of the yarn, each of the S and Z regions comprising at least two primary strand segments whose direction of twist is opposite to that of the region, and with zero twist nodes between each S and Z region, wherein the improvement comprises a secondary strand plied with and alternately-twisted around the primary strands, the node interval of the secondary strand being substantially the same as that of the primary strands, the nodes of the secondary strand being displaced with respect to the nodes of the primary strands, and the twist level between nodes for the secondary strand being less than that of the primary strands.

A preferred product is one as above wherein the primary strands are bulked, continuous filament carpet yarns, the secondary strand is antistatic, and at least some of the secondary strand nodes ($\sim 10\%$) are formed by wrapping of the secondary strand around only one of the primary strands in a portion of a primary node.

Another preferred product is one wherein the improvement comprises an antistatic secondary strand plied with and alternately-twisted around the primary strands, and at least some of the secondary strand nodes are formed by wrapping of the secondary strand around only one of the primary strands in a portion of a primary node.

DETAILED DESCRIPTION OF THE DRAWINGS

Figure 1:
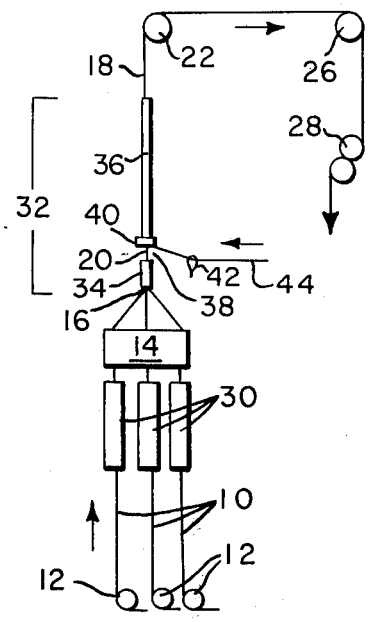
FIG. 1 is a schematic representation of a preferred, vertical, apparatus arrangement for practicing the method of this invention.
Figure 2:
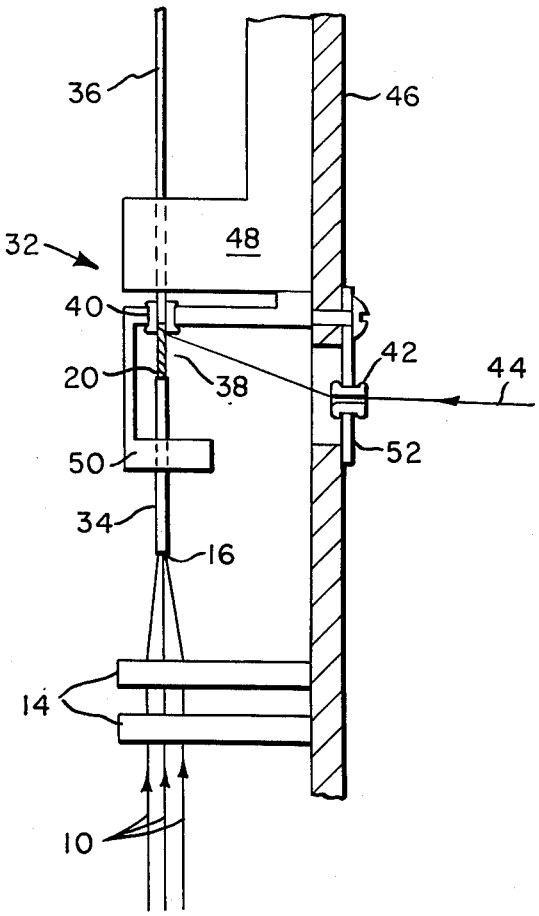
FIG. 2 is a more detailed apparatus arrangement with respect to the converging and constraining zones of the method.

Referring to FIGS. 1 and 2, two or more individual primary strands 10 are fed through tensioning devices (not shown) which assure a uniform tension on the strands, passed around rolls 12, and through tubes 30. Tubes 30 assure separation of the strands to prevent them from contacting one another and plying upstream of twisting means 14. The strands then pass through twisting means 14 where they are separately twisted alternately in opposite directions. Twisting means 14 preferably is a pair of fluid torque jets positioned next to each other in tandem for each strand; one jet twists the strand in a clockwise direction, the other alternately twists the strand in a counterclockwise direction. Suitable jets are described in British patent specification No. 1,047,503. Mechanical twisters may be used instead. A short distance downstream of twisting means 14 is constraining zone 32 which serves to converge the strands and to constrain them sufficiently to slow the untwisting and the plying action as taught in U.S. Pat. No. 3,468,120. Constraining zone 32 consists of a constraining tube in two sections, lower section 34 and upper section 36, separated by a gap 38. Positioned within gap 38 in axial alignment with the tubes is convergence guide 40 for converging secondary strand 44 with the converged, untwisting primary strands 20. Secondary strand 44 is supplied from a tension controlled source (not shown) through guide 42. Primary strands 10 are converged at convergence point 16 at the entrance to lower constraining tube section 34. The plying action takes place between convergence point 16 and snubbing roll 22 over which the yarn passes downstream of the constraining zone 32. The plied yarn 18 then passes around guide roll 26 to take-up rolls 28 and finally to a package windup (not shown). Arrows in FIG. 1 indicate the direction of strand travel.

Referring to FIG. 2, secondary strand 44 is shown passing through guide 42 held by plate bracket 52 fastened to supporting plate 46. Plate 46 also supports bracket 48 for holding upper tube section 36 and bracket 50 for holding convergence guide 40 and lower tube section 34. The distance between convergence point 16 and convergence guide 40 is an important factor in controlling the plying action of the secondary strand 44 with the untwisting, primary strand 20.

Figure 3:
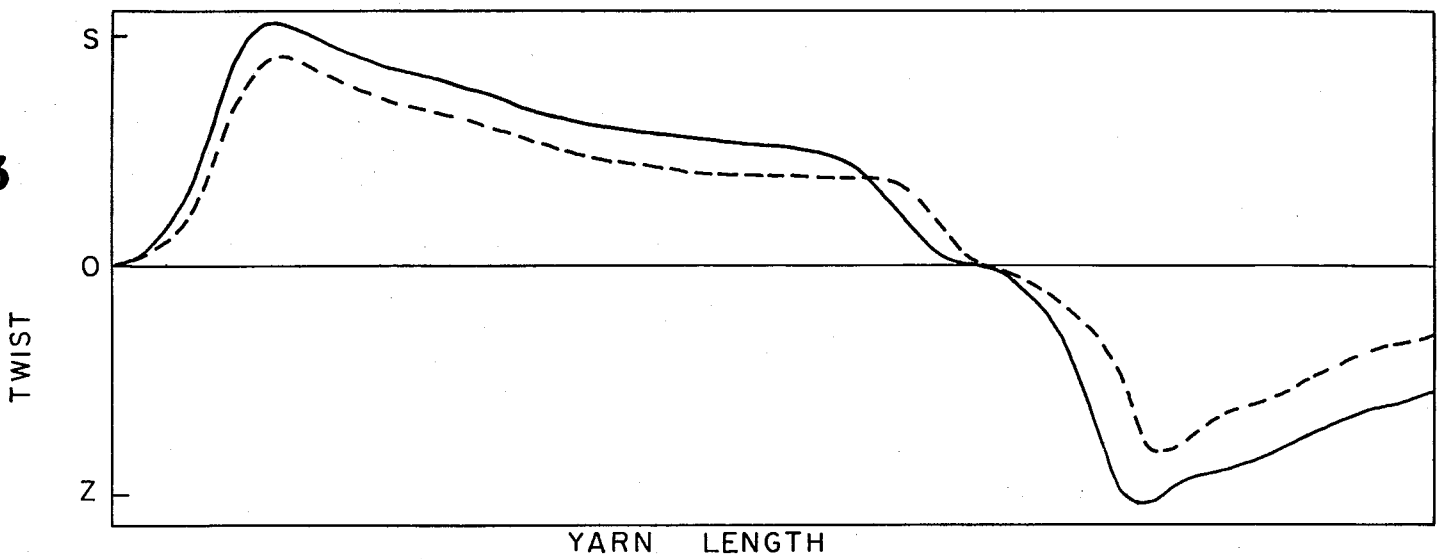
FIGS. 3 and 4 graphically illustrate twist profiles for two different plied yarns obtainable by this invention.
Figure 4:
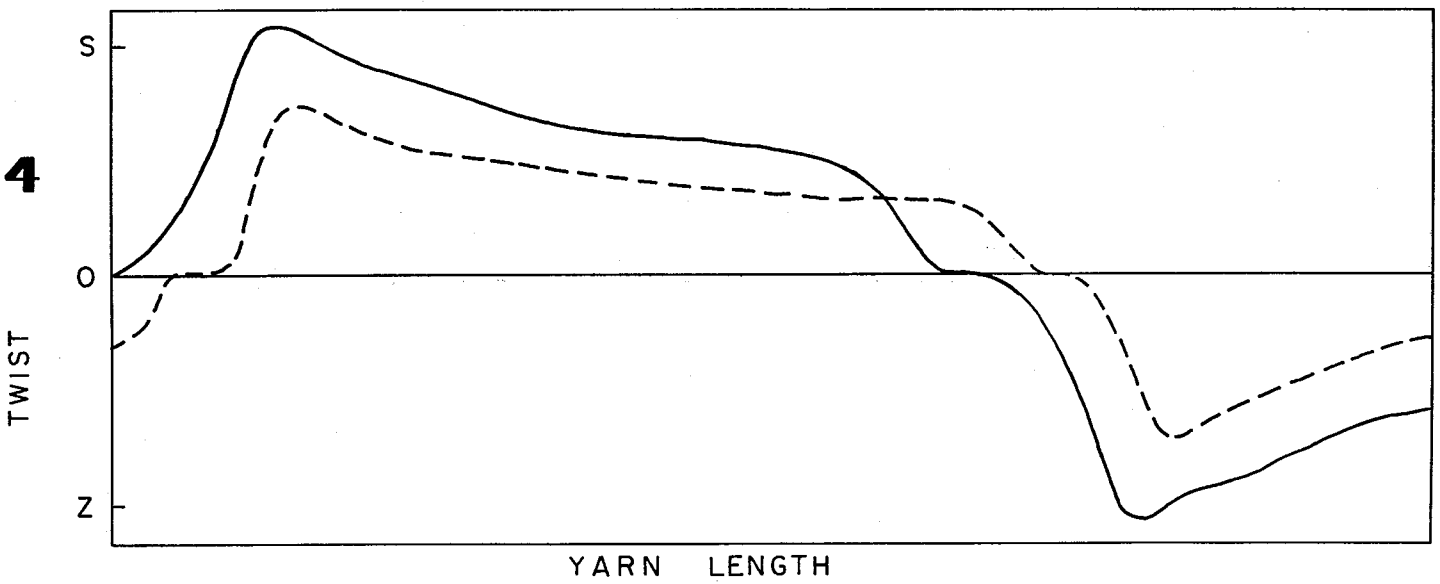

Referring to FIGS. 3 and 4, twist (S or Z in turns per unit length) is plotted versus plied yarn length for the primary strands (solid line) and for the secondary strand (broken line) for two yarn samples for a sample length of about 1.5 node intervals. It is readily apparent from the graphs that the average twist level for the secondary strand is lower than that for the primary strands. The node intervals for the primary and secondary strands are substantially equal as seen by approximately equal distances between nodal crossover points on the zero twist axis for each strand. Due to the nature of the process, the node intervals for the secondary strand are directly dependent upon the primary strand node intervals.

FIG. 3 shows a secondary node being shorter than and displaced with respect to, but overlapping the corresponding node for the primary strands. The twist profile shown corresponds to a uniformity index of about 1.7 and a twist ratio of about 0.9.

FIG. 4 shows a yarn where the secondary strand was converged at a greater downstream distance from the primary strand convergence point as compared to FIG. 3. The primary and secondary nodes are displaced so that they do not overlap one another, also the twist ratio is lower. For a short distance between the nodes, the primary and secondary strands have opposite directions of twist. Wrapping of the primary node by the secondary strand tends to stabilize the primary node. This twist profile corresponds to a twist ratio of about 0.7.

DESCRIPTION OF THE INVENTION

The method of this invention is closely related to the method for making alternate-twist plied yarns as described in U.S. Pat. No. 3,468,120. In that method alternately-twisted strands are converged without snubbing immediately downstream of the twisting point and snubbed at a point downstream of the twisting point a distance less than the distance between yarn nodes and greater than half the distance between nodes. The untwisting of the strands is constrained as taught in U.S. Pat. No. 3,468,120 to produce a yarn with a more uniform ply-twist profile (uniformity index as defined in the patent). With respect to this prior method, this invention comprises converging a secondary strand with the primary strands at a point downstream of the convergence point of the primary strands and within the constraining zone. The distance between these two convergence points is directly but not linearly related to the displacement of nodes and lower twist level produced for the secondary strand with respect to the node position and twist level of the primary strands. In other words, the greater the distance the greater the node displacement and the lower the twist level in the secondary strand.

The alternating false-twist preferably is applied to all the primary strands in phase (with nodes and like twist zones in register) and the strands converged in phase whereby the nodes in the primary strands of the plied yarn correspond to the nodes in the individual primary strands. For aesthetic reasons, particularly in carpet yarns, the direction of twisting is reversed preferably at equal intervals whereby the node intervals are substantially equal.

By having the twisted zones of the primary strands in register and the strands converged in phase, maximum plying torque is developed upon untwisting which facilitates plying of the secondary strand by minimizing the effects of tension and denier of the secondary strand on the normal plying action of the primary strands.

It is not necessary for the secondary strand to contain any alternating false-twist prior to convergence with the primary strands. However, since the secondary strand contributes no torque to the plying action, the denier of the secondary strand should be less than that of each primary strand; for the same reason, the secondary strand should be supplied at low tension. For fine denier (less than 100) secondary strands fed to heavy denier (above 1000) primary strands, secondary strand feed tensions of eight grams or less are suitable.

The distance between the two convergence points must not be too great or inadequate ply-twisting of the secondary strand will result. Normally this distance should be less than about 10 inches. Shorter distances such as less than 3.5 inches are usually preferred since the most intense ply-twisting action occurs in the region immediately following convergence of the primary strands. This is the reason for constraining the untwisting in this region. A distance between convergence points of less than 1.5 inches, for example 1.25 inches, provides excellent overall results with anti-static carpet yarns as shown in the examples.

As used herein, the term "primary strand" refers to the strand to which the false-twist is applied alternately in opposite directions and which constitutes the major portion of the plied yarn denier. Particularly suitable primary strands are yarns of synthetic, continuous filaments, preferably when they have been bulked by crimping the filaments. The filaments may be comprised of any synthetic, fiber-forming polymer such as polyamides, polyesters, polyacrylics, and polyolefins.

The term "secondary strand" refers to the modifying strand which is converged with the primary strands downstream of their convergence point. The secondary strand comprises a minor portion of the plied yarn denier and imparts a distinctive property to the plied yarn not provided by the primary strands. The secondary strand is preferably a yarn of synthetic, continuous filaments, or of staple fibers, or of a monofilament. The secondary strand may be of any suitable nature, including a strand of split film, which permits processing according to the invention and provides the desirable effect. Desirable modifying or special effects which can be provided by the secondary strand include the properties of luster, coloration, antistatic, differential shrinkage, differential crimping, and so forth.

Antistatic filaments particularly suitable for use as a secondary strand of this invention due to their minimal effect on other yarn properties are those of the type described in U.S. Pat. No. 3,803,453 which comprise filaments having a nonconducting sheath of a synthetic fiber-forming polymer surrounding a conductive core containing electrically conductive carbon black wherein the core constitutes less than 50% by volume of the filament; particularly when the filament core has an electrical resistance of less than $10^{11}$ oms/inch at a direct current potential of 2 kilovolts.

In the plied yarns of the invention, the centers of the nodes of the secondary strand can be displaced with respect to the centers of the nodes of the primary strand. Preferably, the nodes of the secondary strand at least partially overlap the nodes of the primary strands such that the secondary strand twists around at least a portion of a node of the primary strands. Complete node displacement such that there is no overlap leaves the nodes of the secondary strand on the plied yarn surface particularly susceptible to looping and snagging during subsequent processing which may be undesirable. When a secondary node is shorter than the primary node which it overlaps, it is possible for the secondary node to lie completely within the primary node even though their centers are displaced with respect to one another. This relationship can be advantageous with respect to subsequent processability of the plied yarn.

Since the secondary strand is converged with the primary strands after their untwisting has begun, the twist level of the secondary strand in the plied yarn must be less than that of the primary strands. Consequently, the twist of the secondary strand can not fall into complete register with that of the primary strands, which helps to keep the secondary strand at or near the surface of the plied yarn. Good overall results normally occur with the ratio of twist level in the secondary strand to that in the primary strands being less than 1.00 but greater than about 0.75. With antistatic secondary strands comprising less than 5% of the total yarn denier it is preferred that the twist ratio be within the range of less than 1.00 but greater than about 0.9 to obtain the best combination of antistatic performance and processing performance in the manufacture of tufted carpets.

When the primary strands are differentially dyeable carpet yarns a uniformity index between about 1.1 and 1.6 is preferred to reduce undesirable patterning effects in tufted carpets after dyeing.

Node interval is the distance between the centers of two adjacent nodes in the plied yarn. Average twist is the absolute numerical average of twist per unit length taken over a representative length of yarn (several node intervals) regardless of twist direction. The uniformity index is the ratio of average maximum twist to average twist. Maximum twist is the maximum twist level in turns per inch (t.p.i.), encountered in an S or Z section.

Twist is measured with a twist counter in the conventional manner by counting the number of turns required to remove twist from a known sample length. Twist per unit length is then to be calculated.

To determine the ratio of twist for the secondary strand to the primary strands (twist ratio) twist for both types of strands are counted by securing the center of one primary node to a clamp and securing the center of the next adjacent primary node to a twist counting device. The strands are untwisted until all twist is removed from the secondary strand as determined by sliding a probe between the secondary and primary strands from the clamp towards the counter. The secondary twist count is recorded and the secondary strand is cut away. The untwisting continues until all ply twist is removed between the primary strands. Twist ratio is calculated by dividing the secondary strand twist count by the primary strand twist count.

In samples when node displacement causes a short length of opposite twist in the secondary and primary strands between the nodes, the opposite twist is manually counted and removed from the secondary strand before mounting and counting as above. The opposite twist count is added to the secondary strand twist count obtained from the counting device before calculating twist ratio.

EXAMPLE I

This example shows the effectiveness of the invention in improving the performance of an antistatic secondary strand in carpet yarns.

A vertical apparatus arrangement of the type shown in FIG. 1 is used. Fluid jets of the type shown in FIGS. 2–4 of British patent No. 1,047,503 are used except that the strand passageway is cylindrical throughout its length with a diameter of 0.10 inches. The fluid conduit which intersects the passageway tangentially has a diameter of 0.05 inch. The separating tubes 30 are 3¼ inches long with an inner diameter of 3/32 inches. Constraining tubes 34, 36 have an internal diameter of 1/16 inches and a 0.032 inch wall thickness of T-304 seamless stainless steel. Feed rolls 12 are 35 inches from jets 14. Convergence point 16 is about 3 inches from jets 14 and about 32 inches from snubbing roll 22. Lower tube section 34 is 8 inches long and separated by a gap of about 1 inch from upper section 36. Thus the distance between convergence point 16 and convergence guide 40 positioned at the entrance to upper tube section 36 is about 9 inches.

Operating conditions include a feed roll speed of 750 yards per minute, a prejet tension on each primary strand of 90 grams, and a secondary strand feed tension of ~3 grams.

The primary strands consists of 3 differentially-dyeable yarns of poly(hexamethylene adipamide), a basic dyeable, a light-acid dyeable and a deep-acid dyeable yarn. Each 1225 denier yarn contains filaments having 3-dimensional random curvilinear crimp produced by a hot fluid-jet bulking process.

The secondary strand is a 23 denier, 3 filament yarn of filaments having a sheath-core composition wherein a core comprising about 4% of the filament cross-section contains conductive carbon black as described in U.S. Pat. No. 3,803,453; the yarn has a resistance of about 80 megohms per inch when tested as described in the patent.

Three items are prepared — A, B and C. For A and B, air is supplied at a pressure of 85 psig, and at 87 psig for C. The air is alternated between the opposite twisting jets at 237 cycles/minute to give a plied yarn node interval of about 55 inches.

The deep-acid dyeable primary strand for A and B already contains 3 antistatic filaments, which are the same as in the secondary strand, cobulked with the polyamide filaments. A control item comparable to item A, without the supplementary protection provided by the secondary strand, gives a carpet static propensity as described in U.S. Pat. No. 3,803,453 of greater than 3.0 KV.

For A (also a control item not of the invention), the above described secondary strand is converged and plied with one of the primary strands prior to entering the twisting jet so that the secondary strand follows essentially the single strand throughout the final plied yarn.

For B, the secondary strand is converged with the untwisting primary strands at the entrance to upper tube section 36 which is about 9 inches downstream from the convergence point of the primary strands.

C is essentially the same as B except that there is no antistatic yarn cobulked with one of the primary strands.

Carpet antistatic performance is shown in Table 1. Carpet specimens for testing were tufted at $\frac{1}{8}$ inch gauge, $\frac{1}{4}$ inch pile height and 24 ounces per square yard.

Table 1

| | A | B | C |
|---|---|---|---|
| Carpet, KV | 2.9 | 2.3 | 2.4 |
| Uniformity Index | 1.47 | 1.69 | 1.68 |
| Twist Ratio | — | 0.86 | 0.73 |

The superior antistatic performance provided by B and C of the invention is readily apparent. A comparison of C versus B shows C to be essentially as effective as B, which contained the cobulked antistatic yarn end in addition to the antistatic secondary strand. Due to the downstream convergence for the secondary strand in B and C, the secondary strand nodes are displaced such that there is substantially no overlap of the primary nodes. This degree of node displacement resulted in some handling difficulties with the yarn during carpet tufting.

EXAMPLE II

This example demonstrates the effect of various locations of the secondary strand convergence point on twist ratio and on primary and secondary node relationships.

The apparatus, strand compositions and operating conditions are the same as for item C of Example I except air pressure is 85 psig. The total length of constraining tubes 34, 36 is not changed; but their individual lengths are changed to give the specified convergence point, which includes the gap 38 of less than about 1 inch between the two sections. The gap should be as short as reasonably possible to minimize its effect on the twist profile. For the zero convergence point test, a one-piece tube is used.

Alternate-twist plied yarns are prepared with the secondary strand convergence point at 0, 1.25, 3.5, 8.5 and 15.0 inches downstream of the primary strand convergence point (entrance to the contraining tube 34). Plied yarn properties resulting from the different convergence points are shown in Table 2.

Table 2

| Convergence Point, in. | 0 | 1.25 | 3.5 | 8.5 | 15.0 |
|---|---|---|---|---|---|
| Twist Ratio | 0.99 | 0.94 | 0.89 | 0.81 | 0.67 |
| Carpet Static, KV | 2.6 | 2.4–2.6 | 2.4 | 2.2–2.4 | * |
| Uniformity Index | 1.5 | * | 1.79 | 1.58 | * |

* Data not available

With the secondary strand converged at the zero (0) point, it plies in phase with the primary strands except at the nodes. Since the secondary strand is of such a relatively low denier (less than 1/50th that of a primary strand), it sometimes forms its own node by wrapping and unwrapping about only one of the primary strands in the node region, thus shortening the secondary node and holding it close to the primary strands. This node relationship is quite desirable with respect to tufting performance in carpet manufacture — the secondary strand better resists snagging and breakage. Whereas the carpet antistatic performance of this item (2.6 KV) is better than control item A of Example I, repeated tests show that it is not as good as that obtained by downstream convergence in the other items of Table 2 (2.2–2.6 KV).

For the 1.25 inch convergence point, the lower, secondary strand twist cannot follow the higher twist angle of the plied primary strands and has to wrap around the plies of the more highly twisted primary strands. Sometimes at a primary node the secondary strand continues to wrap around the node at one end before forming its own shorter node by wrapping and then unwrapping around only one primary strand in the primary node region and then proceeds again to wrap all of the ply-twisted primary strands. This twist profile (of the type represented by FIG. 3) provides a desirable combination of secondary strand exposure with plied yarn cohesiveness. The secondary node length is about half the primary node length.

For the 3.5 inch convergence point, the secondary nodes are displaced slightly more and the secondary and primary node lengths are about equal.

For the 8.5 inch convergence point the primary and secondary nodes do not overlap and are substantially end-to-end.

For the 15.0 inch convergence point, the plied yarn has a loopy appearance, the nodes are separated with a region of opposite strand twist for a short region inbetween (of the type twist profile represented by FIG. 4), and carpet tufting processibility deteriorates badly.

EXAMPLE III

This example demonstrates process operability with secondary strands of higher denier than in Examples I and II.

Using the same process conditions and primary strands as Example II, a similar effect, on twist profile, visually apparent as a novel patterning effect, is found for a secondary strand which is a 70 denier, 34-filament black nylon textile yarn containing carbon black pigment converged at 1.25, 3.5 and 8.5 inches downstream of the primary convergence point. Another antistatic yarn is prepared using a secondary strand which is a 160 denier yarn comprised of nylon and stainless steel staple fibers and which is converged at the 1.25 inch point.

What is claimed is:

1. In the method for making an alternate-twist, plied yarn including applying false-twist as alternate S and Z regions of twist repeatedly throughout the lengths of at least two, primary, separated, multifilament, textile strands, said regions of twist being separated by nodes of zero twist, converging the false-twisted strands without snubbing immediately downstream of the point at which the twist is applied, and snubbing the converged strands at a point downstream of the twisting point a distance less than the distance between nodes and greater than one-half the distance between nodes, and permitting the twisted regions of the converged strands to partially untwist and to ply-twist with one another while constraining the untwisting of the strands in the plying zone sufficiently to slow down but not prevent untwisting and plying of the strands, the improved method for incorporating a secondary strand into the plied yarn comprising converging a secondary strand with the primary strands at a point in the constrained, plying zone downstream of the convergence point of the primary strands, and permitting the secondary strand to ply with and alternately twist around the primary strands.

2. The method of claim 1 wherein the denier of the secondary strand is lower than the denier of each primary strand.

3. The method of claim 2 wherei the false-twisting is applied to all the primary strands in phase, the strands are converged in phase, and the direction of twisting is reversed at equal intervals.

4. The method of claim 3 wherein there are at least three primary strands.

5. The method of claim 4 wherein the primary strands are synthetic, bulked, continuous filament yarns.

6. The method of claim 5 wherein the secondary strand is converged at a downstream distance less than about ten inches from the convergence point of the primary strands.

7. The method of claim 6 wherein the secondary strand is antistatic.

8. The method of claim 7 wherein the secondary strand has a denier less than five percent of the total plied yarn denier.

9. The method of claim 8 wherein the secondary strand is converged at a downstream distance less than about 1.5 inches from the convergence point of the primary strands.

10. The method of claim 9 wherein the untwisting is constrained to provide a plied yarn having a uniformity index in the range of 1.1 to 1.6.

11. The method of claim 2 wherein the secondary strand is antistatic.

12. An improved unitary, twist-stable yarn including a plurality of alternately-twisted, multifilament strands which are plied about one another by alternating S and Z regions of twist repeatedly throughout the length of the yarn, each of the S and Z regions comprising at least two primary strand segments whose direction of twist is opposite to that of the region, and with zero twist nodes between each S and Z region, wherein the improvement comprises a secondry strand plied with and alternately-twisted around the primary strands, the node interval of the secondary strand being substantially the same as that of the primary strands, the nodes of the secondary strand being displaced with respect to the nodes of the primary strands, and the twist level between nodes for the secondary strand being less than that of the primary strands and wherein the primary strands are bulked, continuous filament, carpet yarns and the secondary strand is antistatic and at least some of the secondary strand nodes are formed by wrapping of the secondary strand around only one of the primary strands in a portion of a primary node.

13. An improved unitary, twist-stable yarn including a plurality of alternately-twisted, multifilament strands which are plied about one another by alternating S and Z regions of twist repeatedly throughout the length of the yarn, each of the S and Z regions comprising at least two primary strand segments whose direction of twist is opposite to that of the region, and with zero twist nodes between each S and Z region, wherein the improvement comprises an antistatic secondary strand plied with and alternately-twisted around the primary strands, the node interval of the secondary strand being substantially the same as that of the primary strands, and at least some of the secondary strand nodes are formed by wrapping of the secondary strand around only one of the primary strands in a portion of a primary node.

* * * * *